US006921889B2

(12) United States Patent
Shon et al.

(10) Patent No.: US 6,921,889 B2
(45) Date of Patent: Jul. 26, 2005

(54) MAGNETRON AND MICROWAVE OVEN AND HIGH FREQUENCY HEATING APPARATUS EACH EQUIPPED WITH THE SAME

(75) Inventors: Jong-Chull Shon, Suwon (KR); Boris V. Rayskiy, Suwon (KR); Hyun-Jun Ha, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/632,802

(22) Filed: Aug. 4, 2003

(65) Prior Publication Data

US 2004/0118841 A1 Jun. 24, 2004

(30) Foreign Application Priority Data

Dec. 6, 2002 (KR) ..... 10-2002-0077273

(51) Int. Cl.[7] ..... H05B 6/64; H01J 23/10
(52) U.S. Cl. ..... 219/761; 315/39.51
(58) Field of Search ..... 219/761, 702; 315/39.51–39.77

(56) References Cited

U.S. PATENT DOCUMENTS 6,774,568 B2 * 8/2004 Yang ..... 315/39.71

FOREIGN PATENT DOCUMENTS

JP 05-041173 2/1993
JP 11-283517 * 10/1999

OTHER PUBLICATIONS

Park, Seung–Ho, Korean Patent Abstract Publication No. 1019930000576, Publication Date 19930125, Application No. 1019900014950, Application Date 19900920, Abstract only.

* cited by examiner

*Primary Examiner*—Philip H. Leung
(74) *Attorney, Agent, or Firm*—Staas & Halsey LLP

(57) ABSTRACT

A magnetron, and a microwave oven and a high frequency heating apparatus each equipped with the same use, a single permanent magnet disposed above or below an anode, a pole piece near the permanent magnet that has a magnetic flux dispersing structure, and another pole piece opposite to the permanent magnet that has a magnetic flux concentrating structure. In accordance with the present invention, even though a single permanent magnet is provided, magnetic flux density is rendered uniform across an activating space, so that the volume and parts of the magnetron are reduced and the curtailment of manufacturing costs is realized.

20 Claims, 11 Drawing Sheets

MAGNETRON AND MICROWAVE OVEN AND HIGH FREQUENCY HEATING APPARATUS EACH EQUIPPED WITH THE SAME

CROSS-REFERENCE TO RELATED APPLICATION

This application claims the benefit of Korean Application No. 2002-77273, filed Dec. 6, 2002, in the Korean Intellectual Property Office, the disclosure of which is incorporated herein by reference.

BACKGROUND OF THE INVENTION

1. Field of the Invention

The present invention relates generally to a magnetron, and microwave oven and high frequency heating apparatus each equipped with the magnetron, and more particularly, to upper and lower pole pieces of a magnetron that carry magnetic flux generated by a permanent magnet in a magnetron into an activating space.

2. Description of the Related Art

As illustrated in FIG. 1, in a magnetron, a cathode including a filament 101 that emits thermions is disposed at the axial center of the magnetron, an anode including a plurality of vanes 102 that constitute resonance circuits and an anode cylinder 103 is provided outside the cathode, and an activating space 104, through which thermions emitted from the cathode move, is formed between the anode and the cathode. To cause the thermions to assume a certain type of movement, the rectilinear movement of the thermions is induced by an electric field caused by a potential difference generated between the cathode and the anode by the application of external electric power, and the rotational movement of the thermions is induced by a magnetic field applied to the activating space by upper and lower permanent magnets 105*a* and 105*b*. To carry magnetic flux generated by the two permanent magnets 105*a* and 105*b* into the activating space 104 (for ease of description, the rotation of a magnet in the direction from the north pole to the south pole thereof is ignored), upper and lower pole pieces 106*a* and 106*b* are provided between the upper permanent magnet 105*a* and the anode and between the lower permanent magnet 105*a* and the anode, respectively With the above-described construction, the thermions reach the anode while traveling spirally by electromagnetic force. At this time, rotational electron poles are generated around the cathode by the thermions and an induced current is generated in the resonance circuit of the anode, so that oscillations are incited and maintained. The magnetron is widely used in home appliances, such as microwave ovens, and is used in industrial applications, such as high frequency heating apparatuses, particle accelerators and radar.

Two permanent magnets are provided above and below the anode and function to render the movement of thermions uniform by forming uniform and symmetrical magnetic flux density in the activating space, thus suppressing the generation of unwanted noise. However, the provision of the two permanent magnets 105*a* and 105*b* increases the height, weight and volume of an overall magnetron. Additionally, the provision of the two permanent magnets 105*a* and 105*b* increases the manufacturing cost of the magnetron by increasing the number of assembly steps.

In order to solve the above-described and/or other problems, a configuration was proposed in which a single permanent magnet is disposed above the anode. As illustrated in the graph of FIG. 2, this type of configuration causes the movement of thermions to be non-uniform due to the non-uniform magnetic flux density thereof, so that a large mount of unwanted noise is generated, thus reducing oscillation efficiency. Accordingly, this type of configuration is employed only in small capacity magnetrons. In the graph of FIG. 2, the X-axis represents a distance ranging from the point of the upper pole piece to a certain point in a direction from the upper pole piece to the lower pole piece in millimeters, with a value "0" allocated to the point of the upper pole piece, and the Y-axis represents a magnetic flux density at the certain point in Teslas (Ts). Alternatively, to overcome the above drawback, there have been attempts to render magnetic flux density uniform by causing the tapered angles or center hole sizes of upper and lower pole pieces to be different, as disclosed in Japanese Pat. Unexamined Pub. No. Hei 5-41173. However, in accordance with these attempts, parts perpendicular to the axial center of an anode are maintained at the ends of the tapered surfaces of upper and lower pole pieces, so that the entire magnetic flux is dispersed, thus reducing the oscillation efficiency of a magnetron compared with the magnetic flux capacity of the magnet.

SUMMARY OF THE INVENTION

Accordingly, it is an aspect of the present invention to provide a magnetron, and microwave oven and high frequency heating apparatus each equipped with the same, in which a single permanent magnet is disposed above or below an anode, a pole piece near the permanent magnet has a magnetic flux dispersing structure, and another pole piece opposite to the permanent magnet has a magnetic flux concentrating structure, thus allowing magnetic flux density uniform across an activating space of the magnetron.

Additional aspects and/or advantages of the invention will be set forth in part in the description which follows and, in part, will be obvious from the description, or may be learned by practice of the invention.

The foregoing and/or other aspects of the present invention may be achieved by providing a magnetron, including a ring-shaped anode forming a plurality of resonance circuits, a cathode disposed at an axial center of the anode to emit thermions, an activating space formed between the anode and the cathode, a ring-shaped permanent magnet provided above the anode, an upper pole piece having a magnetic flux dispersing structure to carry magnetic flux generated by the permanent magnet to an upper portion of the activating space, a lower pole piece carrying the magnetic flux to a lower portion of the activating space, and at least one yoke magnetically connecting the permanent magnet with the lower pole piece.

The upper pole piece may include a ring-shaped magnetic flux receiving portion disposed between the permanent magnet and the anode to receive magnetic flux generated by the permanent magnet, a slanted portion downwardly slantingly extended from an inner edge of the ring-shaped magnetic flux receiving portion to an upper portion of the activating space to carry received magnetic flux to the upper portion of the activating space, and a magnetic flux dispersing portion upwardly slantingly extended from an inner edge of the slanted portion to disperse the carried magnetic flux.

The foregoing and/or other aspects of the present invention may be achieved by providing a magnetron, including a ring-shaped anode forming a plurality of resonance circuits, a cathode disposed at an axial center of the anode to emit thermions, an activating space formed between the anode and the cathode, a ring-shaped permanent magnet provided above the anode, an upper pole piece carrying magnetic flux generated by the permanent magnet to an upper portion of the activating space, a lower pole piece comprising a ring-shaped magnetic flux receiving portion designed to receive magnetic flux carried through the yokes from the permanent magnet, a slanted portion upwardly slantingly extended from an inner edge of the ring-shaped magnetic flux receiving portion to a lower portion of the activating space to carry received magnetic flux to the lower portion of the activating space, and at least one yoke magnetically connecting the permanent magnet with the lower pole piece.

The foregoing and/or other aspects of the present invention may be achieved by providing a magnetron, including a ring-shaped anode forming a plurality of resonance circuits, a cathode disposed at an axial center of the anode to emit thermions, an activating space formed between the anode and the cathode, a ring-shaped permanent magnet provided above the anode, an upper pole piece having a magnetic flux dispersing structure to carry magnetic flux generated by the permanent magnet to an upper portion of the activating space, a lower pole piece having a magnetic flux concentrating structure to carry the magnetic flux to a lower portion of the activating space, and at least one yoke magnetically connecting the permanent magnet with the lower pole piece.

The upper pole piece may include a ring-shaped magnetic flux receiving portion disposed between the permanent magnet and the anode to receive magnetic flux generated by the permanent magnet, a slanted portion downwardly slantingly extended from an inner edge of the ring-shaped magnetic flux receiving portion to an upper portion of the activating space to carry received magnetic flux to the upper portion of the activating space, and a magnetic flux dispersing portion upwardly slantingly extended from an inner edge of the slanted portion to disperse the carried magnetic flux.

The lower pole piece may include a ring-shaped magnetic flux receiving portion designed to receive magnetic flux carried through the yokes from the permanent magnet, and a slanted portion upwardly slantingly extended from an inner edge of the ring-shaped magnetic flux receiving portion to the lower portion of the activating space to carry received magnetic flux to the lower portion of the activating space.

The foregoing and/or other aspects of the present invention may be achieved by providing a magnetron, including a ring-shaped anode forming a plurality of resonance circuits, a cathode disposed at an axial center of the anode to emit thermions, an activating space formed between the anode and the cathode, a ring-shaped permanent magnet provided below the anode, an upper pole piece having a magnetic flux dispersing structure to carry magnetic flux generated by the permanent magnet to an upper portion of the activating space, a lower pole piece carrying the magnetic flux to a lower portion of the activating space, and at least one yoke magnetically connecting the permanent magnet with the lower pole piece.

The lower pole piece may include a ring-shaped magnetic flux receiving portion disposed between the permanent magnet and the anode to receive magnetic flux generated by the permanent magnet, a slanted portion downwardly slantingly extended from an inner edge of the ring-shaped magnetic flux receiving portion to an upper portion of the activating space to carry received magnetic flux to the upper portion of the activating space, and a magnetic flux dispersing portion upwardly slantingly extended from an inner edge of the slanted portion to disperse the carried magnetic flux.

The foregoing and/or other aspects of the present invention may be achieved by providing a magnetron, including a ring-shaped anode forming a plurality of resonance circuits, a cathode disposed at an axial center of the anode to emit thermions, an activating space formed between the anode and the cathode, a ring-shaped permanent magnet provided above the anode, a lower pole piece carrying magnetic flux generated by the permanent magnet to an upper portion of the activating space, an upper pole piece comprising a ring-shaped magnetic flux receiving portion designed to receive magnetic flux carried through the yokes from the permanent magnet, and a slanted portion upwardly slantingly extended from an inner edge of the ring-shaped magnetic flux receiving portion to a lower portion of the activating space to carry received magnetic flux to the lower portion of the activating space, and at least one yoke magnetically connecting the permanent magnet with the lower pole piece.

The foregoing and/or other aspects of the present invention may be achieved by providing a magnetron, including a ring-shaped anode forming a plurality of resonance circuits, a cathode disposed at an axial center of the anode to emit thermions, an activating space formed between the anode and the cathode, a ring-shaped permanent magnet provided above the anode, a lower pole piece having a magnetic flux dispersing structure to carry magnetic flux generated by the permanent magnet to an upper portion of the activating space, an upper pole piece having a magnetic flux concentrating structure to carry the magnetic flux to a lower portion of the activating space, and at least one yoke magnetically connecting the permanent magnet with the lower pole piece.

The lower pole piece may include a ring-shaped magnetic flux receiving portion disposed between the permanent magnet and the anode to receive magnetic flux generated by the permanent magnet, a slanted portion downwardly slantingly extended from an inner edge of the ring-shaped magnetic flux receiving portion to an upper portion of the activating space to carry received magnetic flux to the upper portion of the activating space, and a magnetic flux dispersing portion upwardly slantingly extended from an inner edge of the slanted portion to disperse the carried magnetic flux.

The upper pole piece may include a ring-shaped magnetic flux receiving portion designed to receive magnetic flux carried through the yokes from the permanent magnet, and a slanted portion upwardly slantingly extended from an inner edge of the ring-shaped magnetic flux receiving portion to the lower portion of the activating space to carry received magnetic flux to the lower portion of the activating space.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
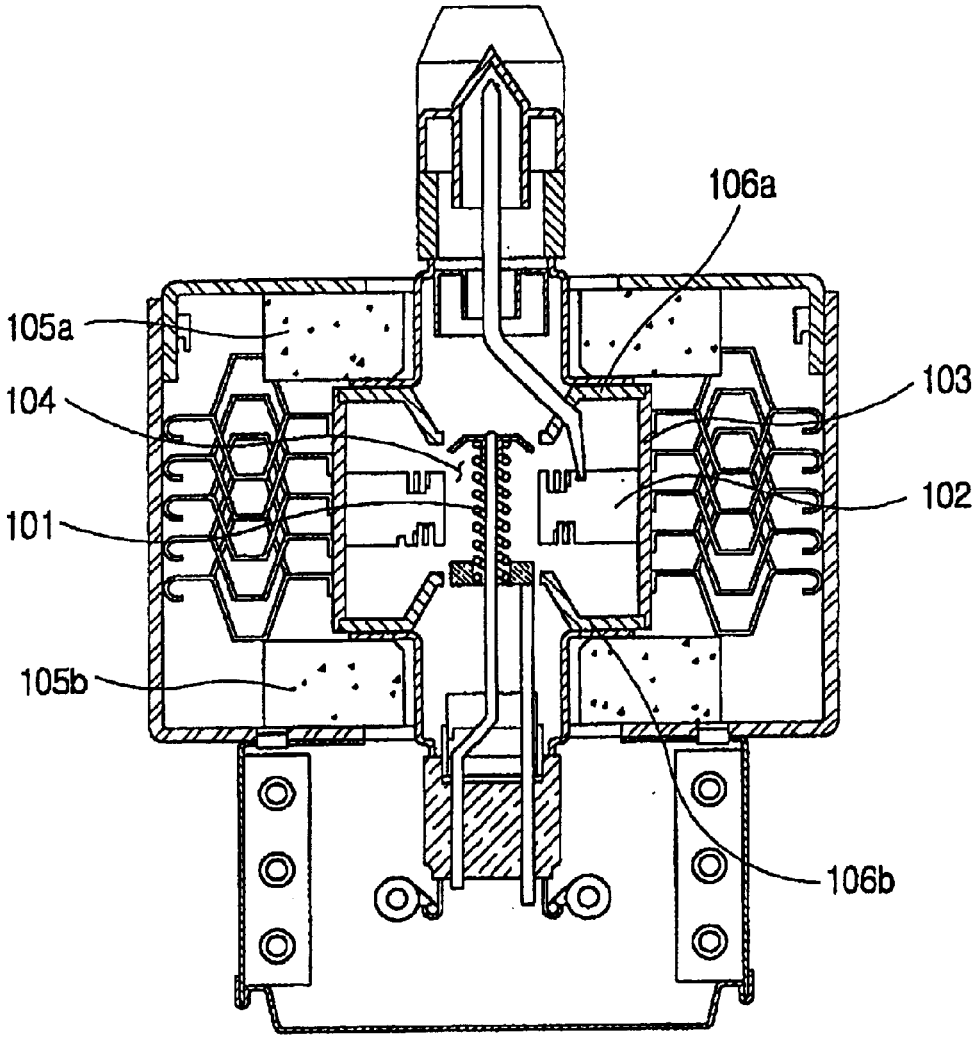
FIG. 1 PRIOR ART
FIG. 1 is a longitudinal cross section of a prior art magnetron.
Figure 2:
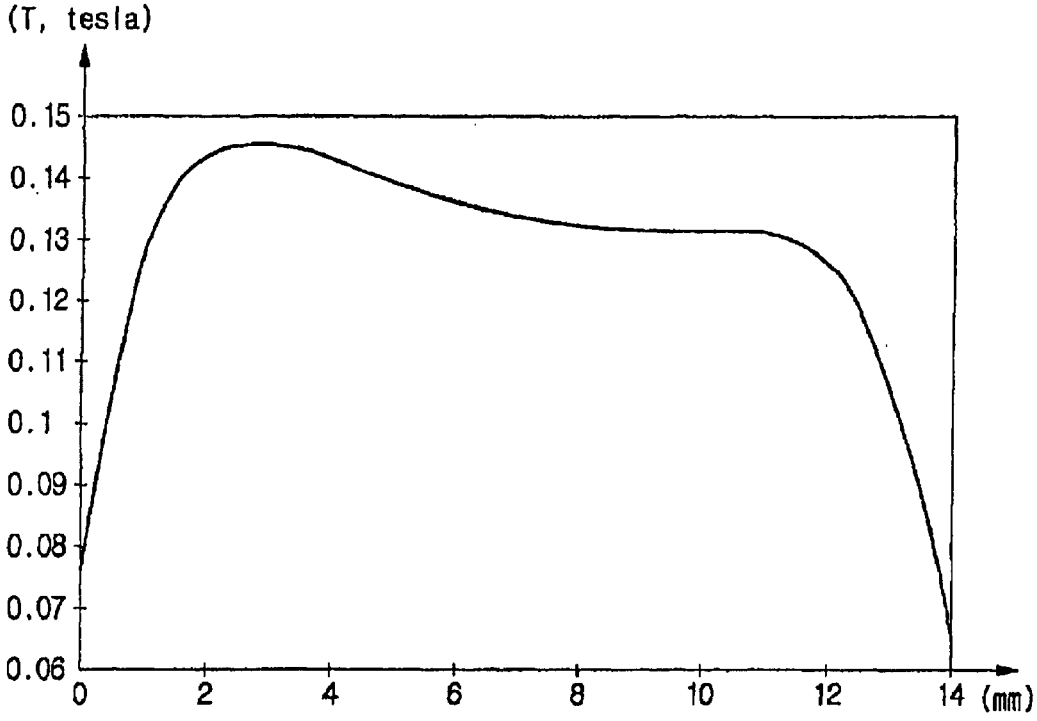
FIG. 2 PRIOR ART
FIG. 2 is a graph showing the distribution of magnetic flux density across the activating space of another prior art magnetron equipped with a single permanent magnet.

Reference will now be made in detail to the present preferred embodiments of the present invention, examples of which are illustrated in the accompanying drawings, wherein like reference numerals refer to the like elements throughout. The embodiments are described below in order to explain the present invention by referring to the figures. Additionally, for clarity of description, the rotational direction of magnetic flux due to the polarization of north and south poles of a magnet is ignored, and it is assumed that both the north and south poles emit magnetic flux.

Figure 3:
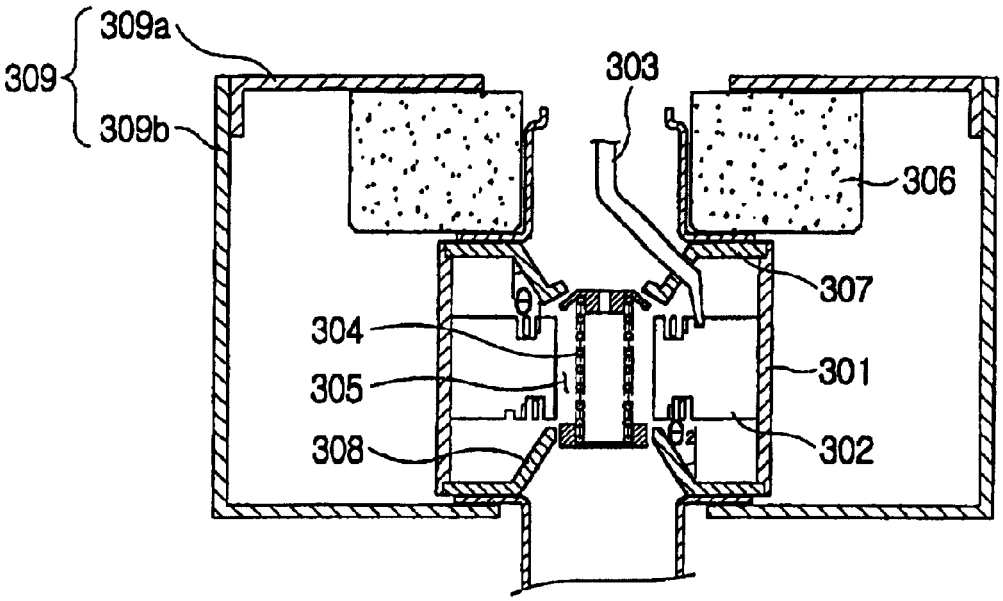
FIG. 3 is a partial longitudinal cross section of a principal portion of a magnetron, according to an embodiment of the present invention.

FIG. 3 is a longitudinal section showing a principal portion of a magnetron according to an embodiment of the present invention. As illustrated in FIG. 3, a plurality of vanes 302 that constitute an anode together with a ring-shaped anode cylinder 301 are axially inwardly arranged at regular intervals to form resonance circuits. An antenna is attached to one of the vanes 302 to carry harmonics to the outside.

A filament 304 in the form of a coil spring is disposed at the axial center of the anode cylinder 301. An activating/predetermined space 305 is provided between the filament 304 and the front ends of the vanes 302. A ring-shaped permanent magnet 306 is placed above the anode to apply magnetic flux to the activating space 305. Upper and lower pole pieces 307 and 308 are provided to carry magnetic flux generated by the permanent magnet 306 to the activating space 305.

The upper pole piece 307 is brought into tight contact with the permanent magnet 306, and can carry sufficient magnetic flux to the activating space 305. In contrast, the lower pole piece 308 is positioned opposite to the permanent magnet 306, that is, below the anode, and connected to the permanent magnet 306 through the upper and lower yokes 309*a* and 309*b*. The lower pole piece 308 functions to carry magnetic flux, which is carried from the permanent magnet 306 through the upper and lower yokes 309*a* and 309*b*, to the lower portion of the activating space 305.

Accordingly, in this embodiment, a dosed magnetic circuit is formed that includes elements arranged in the order of the permanent magnet 306, the upper pole piece 307, the activating space 305, the lower pole piece 308, the lower yoke 309*b* and the upper yoke 309*a* (in this case, the top of the permanent magnet 306 is assumed to be a north pole, and the rotational direction of magnetic flux from a north pole to a south pole is considered). In the meantime, magnetic flux applied from the lower pole piece 308 to the lower portion of the activating space 305 leaks while moving from the permanent magnet 306 through the upper and lower yokes 309*a* and 309*b*, so uniform magnetic flux is formed in the activating space 305.

Figure 4:
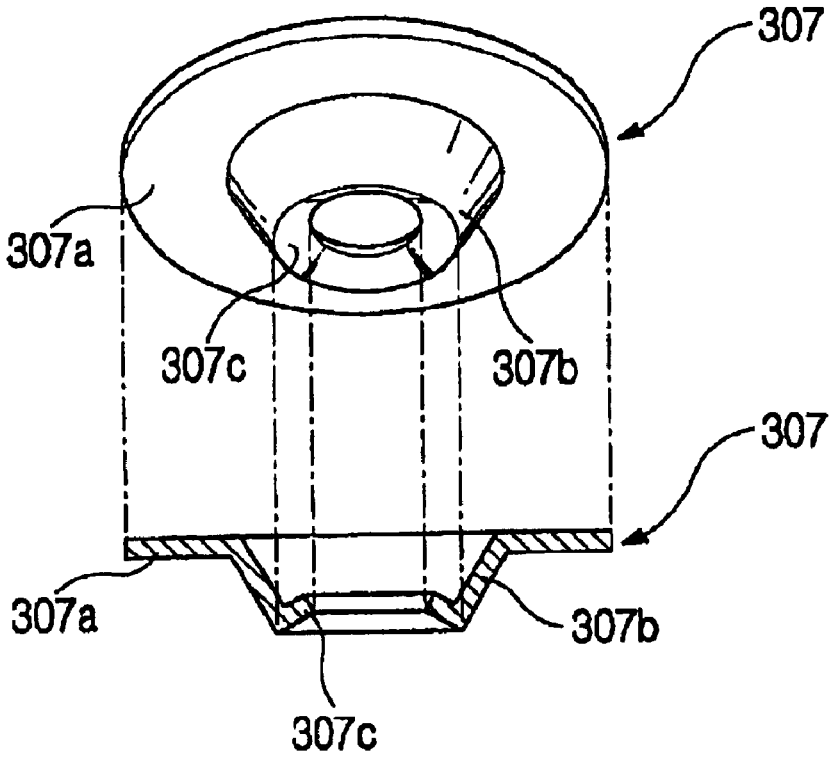
FIG. 4 is a perspective view and longitudinal cross section of an upper pole piece of FIG. 3.

Accordingly, in order to overcome the above problem, in this embodiment, the upper pole piece 307 has a structure that disperses magnetic flux, as is shown in FIGS. 3 and 4. The upper pole piece 307 is constructed to include a ring-shaped magnetic flux receiving portion 307*a* disposed between the permanent magnet 306 and the anode to receive magnetic flux generated by the permanent magnet 306, a slanted portion 307*b* downwardly slantingly extended from the inner edge of the ring-shaped magnetic flux receiving portion 307*a* to the upper portion of the activating space 305 to carry received magnetic flux to the upper portion of the activating space 305, and a magnetic flux dispersing portion 307*c* upwardly slantingly extended from the inner edge of the slanted portion 307*b* to disperse the carried magnetic flux.

Figure 5:
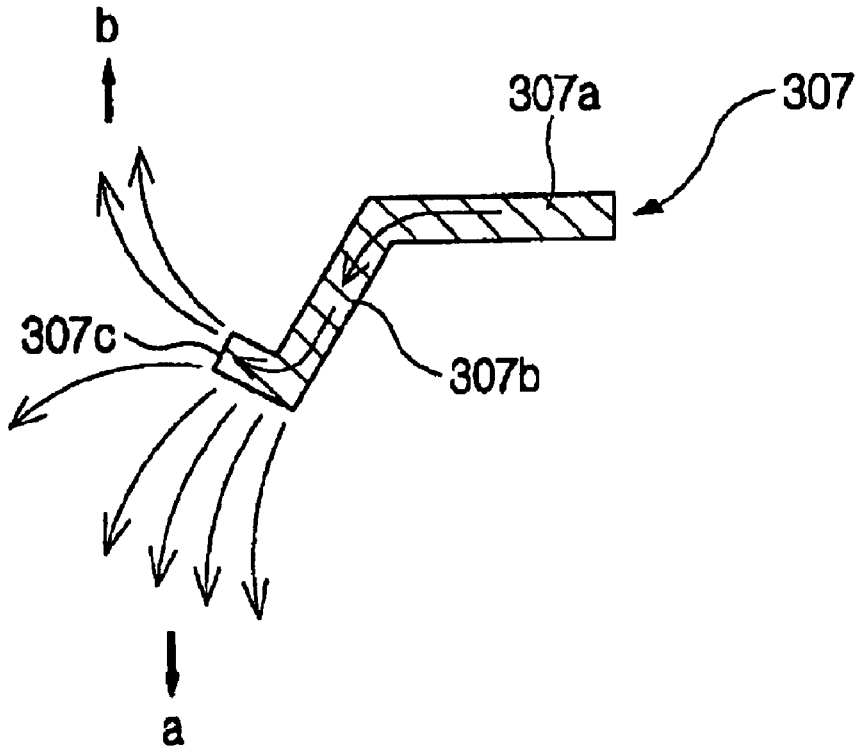
FIG. 5 is a longitudinal cross section showing a magnetic flux dispersion phenomenon at the upper pole piece of FIG. 3.

A phenomenon in which magnetic flux is dispersed by the upper pole piece 307 having a structure shown in FIGS. 3 and 4 is illustrated by arrows in FIG. 5. The arrows in a "b" direction represent magnetic flux carried to the upper portion of the activating space 305, and the arrows in an "a" direction represent magnetic flux dispersed by the magnetic flux dispersing portion 307*c*.

Figure 6:
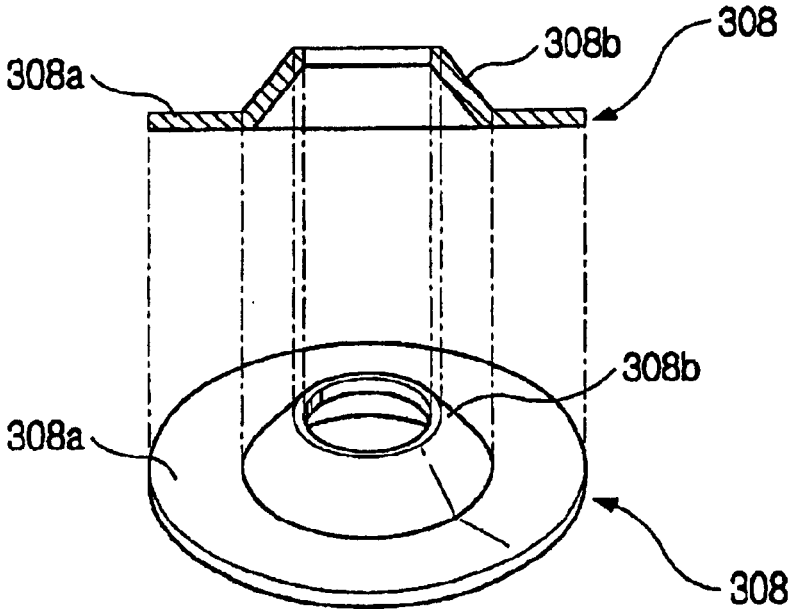
FIG. 6 is a perspective view and longitudinal cross section of a lower pole piece of FIG. 3.

In contrast, the lower pole piece 308 has a magnetic flux concentrating structure that carries magnetic flux through the upper and lower yokes 309 to the lower portion of the activating space 305 without the distribution of the magnetic flux, as illustrated in FIGS. 3 and 6. The lower pole piece 308 according to this embodiment of the present invention is constructed to include a ring-shaped magnetic flux receiving portion 308*a* designed to receive magnetic flux carried through the upper and lower yokes 305 from the permanent magnet 306 and a slanted portion 308*b* upwardly slantingly extended from the inner edge of the ring-shaped magnetic flux receiving portion 308*a* to the lower portion of the activating space 305 to carry received magnetic flux to the lower portion of the activating space 305. With this structure, magnetic flux is concentrated from the inner edge of the slanted portion 308*b* onto the lower portion of the activating space 305, so that magnetic flux having a magnitude similar to that of magnetic flux applied from the upper pole piece 307 can be applied to the activating space 305, thus rendering magnetic flux density uniform.

Figure 7:
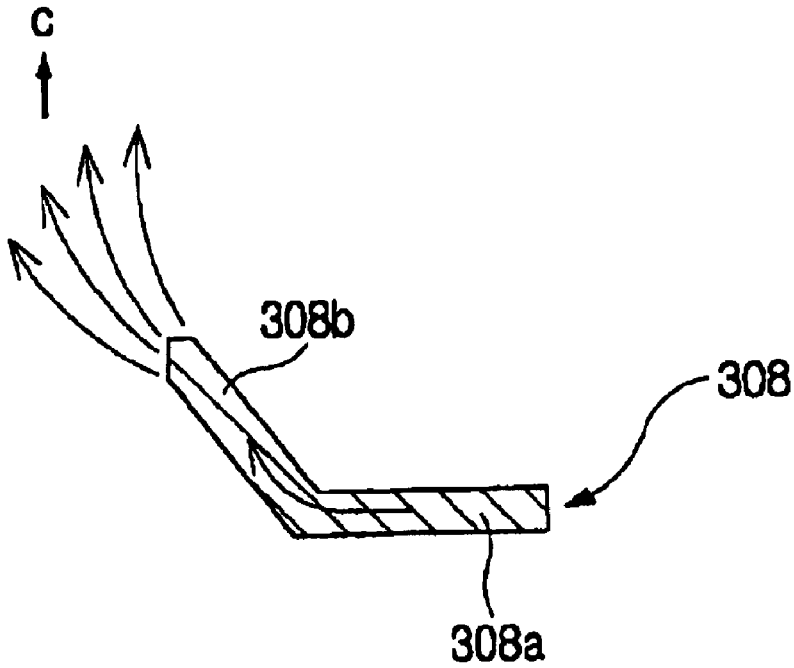
FIG. 7 is a longitudinal cross section showing a magnetic flux concentration phenomenon at the lower pole piece of FIG. 3.

A phenomenon in which magnetic flux is concentrated by the lower pole piece 308 having an above-described structure is illustrated by arrows in FIG. 7. The arrows in a "b" direction represent magnetic flux carried to the upper portion of the activating space 305, and the arrows in an "a" direction represent magnetic flux dispersed by the magnetic flux dispersing portion 307*c*. With the structures of the upper and lower pole pieces 307 and 308 shown in FIGS. 4 through 7, respectively, uniform magnetic flux is maintained across the activating space 305 regardless of the position of the activating space 305, so that the movement of thermions is rendered uniform and the generation of unwanted noise is suppressed.

As shown in FIGS. 4 and 6, it will be appreciated that an angle $\theta_2$ between the magnetic flux receiving portion 308*a* and slanted portion 308*b* of the lower pole piece 308 is greater than an angle $\theta_2$ between the magnetic flux receiving portion 307*a* and slanted portion 307*b* of the upper pole piece 307. This construction is an example of one of the characteristics of the present invention, and is designed to maximally suppress magnetic flux leakage by sharply bending the slanted portion 308*b* of the lower pole piece 308 extended from the magnetic flux receiving portion 308*a* of the lower pole piece 308.

In the magnetron having the above-described construction, when external power is applied to the filament 304, the filament is heated by operational current applied to the filament 304, and thermions are emitted from the heated filament 304 and reach the front ends of the vanes 302 while undergoing combined straight and rotating movement by the influence of electric and magnetic fields formed in the activating space 305. Accordingly, an electric potential difference is alternately applied to each pair of neighboring vanes 302.

As a result, harmonics are generated to correspond to the rotational speed of a group of thermions, and are transmitted to the outside through the antenna 303. In this case, as illustrated by line "a" of FIG. 8, magnetic flux density in the activating space 305 of the magnetron of this embodiment is kept relatively uniform across the upper, center and lower portions of the activating space 305, so the movement of thermions may be rendered uniform. Line "b" of FIG. 8 represents magnetic flux density in the activating space of a related art magnetron in which two permanent magnets are disposed in the upper and lower portions of the magnetron, respectively.

Figure 8:
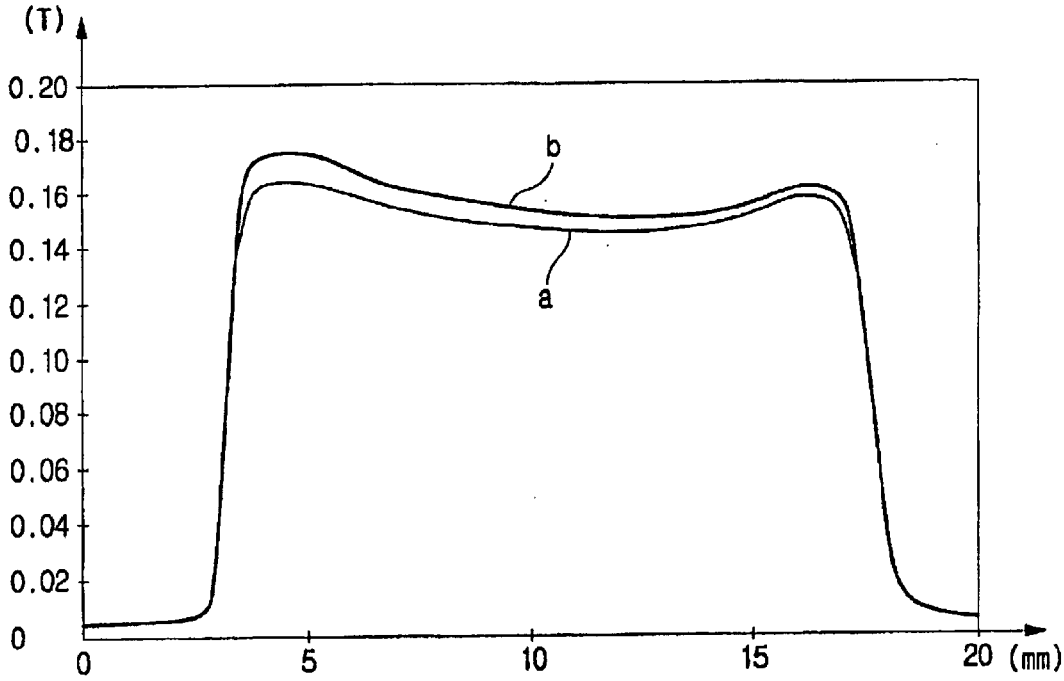
FIG. 8 is a graph showing the distribution of magnetic flux density across the activating spaces of the related art magnetron and the magnetron of the present invention.

In the graph of FIG. 8, the X-axis represents a distance ranging from the point of the upper pole piece to a certain point in a direction from the upper pole piece to the lower pole piece in millimeters, with a value "0" allocated to the point of the upper pole piece, and the Y-axis represents magnetic flux density at the certain point in Teslas (Ts). As illustrated in FIG. 8, the distribution of magnetic flux density in the magnetron of the present invention is substantially similar to that in the related art magnetron in which two permanent magnets are provided in the upper and lower portions of the magnetron, respectively, so the magnetron of the present invention allows the movement of thermions to be uniform, thus suppressing the generation of unwanted noise.

Thermions come into collision with, and are absorbed into, the front ends of the vanes constituting the anode, so that the anode is maintained at a high temperature, and heat is transmitted from the anode to the permanent magnet. Accordingly, the heat moved to the permanent magnet reduces the magnetism of the permanent magnet, so that the oscillation efficiency of the magnetron is reduced. In the past, permanent magnets are generally provided above and below an anode of a magnetron, so that heat emitted to positions above and below the anode is absorbed by the permanent magnets, thus weakening the magnetic flux of the permanent magnets. However, in the present invention, a single large permanent magnet is disposed above an anode to apply a same amount of magnetic flux, so that heat emitted to a position below the permanent magnet is discharged to the air, but only heat emitted to a position above the permanent magnet is absorbed by the permanent magnet. Accordingly, in the magnetron of the present invention, the rate of reduction of the magnetic flux of the magnet is relatively small, and the oscillation efficiency of the magnetron is increased. As a result, when magnetrons having the same oscillation efficiency are manufactured, the magnetron of the present invention may be manufactured with a single permanent magnet smaller than the sum of two upper and lower permanent magnets provided therein.

Figure 9:
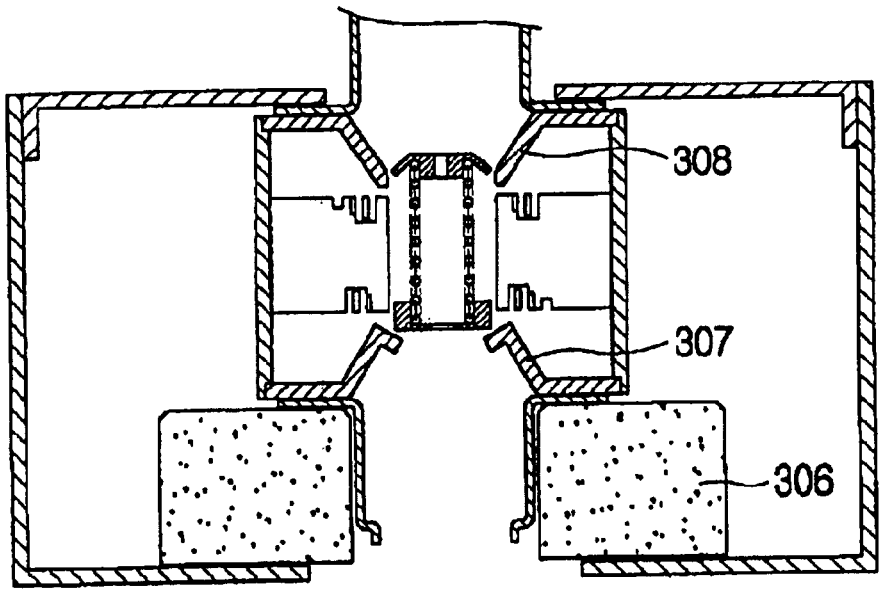
FIG. 9 is a partial longitudinal cross section of a principal portion of a magnetron, according to another embodiment of the present invention.

FIG. 9 is a partial longitudinal cross section of a principal portion of a magnetron according to another embodiment of the present invention, in which a permanent magnet 306 is provided below an anode, which is different from the magnetron according to the former embodiment of the present invention. In this case, like the description with reference to FIGS. 1 to 7, a lower pole piece 308 near the permanent magnet 306 has a magnetic flux dispersing structure, and an upper pole piece 307 opposite to the permanent magnet 306 has a magnetic flux concentrating structure, so that the uniformity of magnetic flux density across the activating space of the magnetron may be realized.

The magnetron having the above-described construction may be applied to a variety of apparatuses that require a magnetron. In particular, the magnetron of the present invention may be applied to a widely known high frequency heating apparatus or microwave oven, thus reducing the manufacturing cost thereof and increasing the operational efficiency thereof.

The magnetron of the present invention is not limited to the above-described embodiments. Additionally, it is not necessary for both the magnetic flux dispersing structure and the magnetic flux concentrating structure to be included in a single magnetron at the same time. The reason is that the aspect of the present invention may be achieved with either the magnetic flux dispersing structure or the magnetic flux concentrating structure.

In accordance with the present invention, even though a single permanent magnet is provided, magnetic flux density is rendered uniform across an activating space, so the volume of the magnetron is reduced and the curtailment of manufacturing costs is realized.

Additionally, the demagnetization of the permanent magnets due to the heating of the magnetron is reduced, so that the oscillation efficiency of the magnetron is increased.

In the meantime, a microwave oven and a high frequency heating apparatus each equipped with the above-described magnetron contribute to the reduction of manufacturing costs and the increase of operational efficiency.

Figure 10:
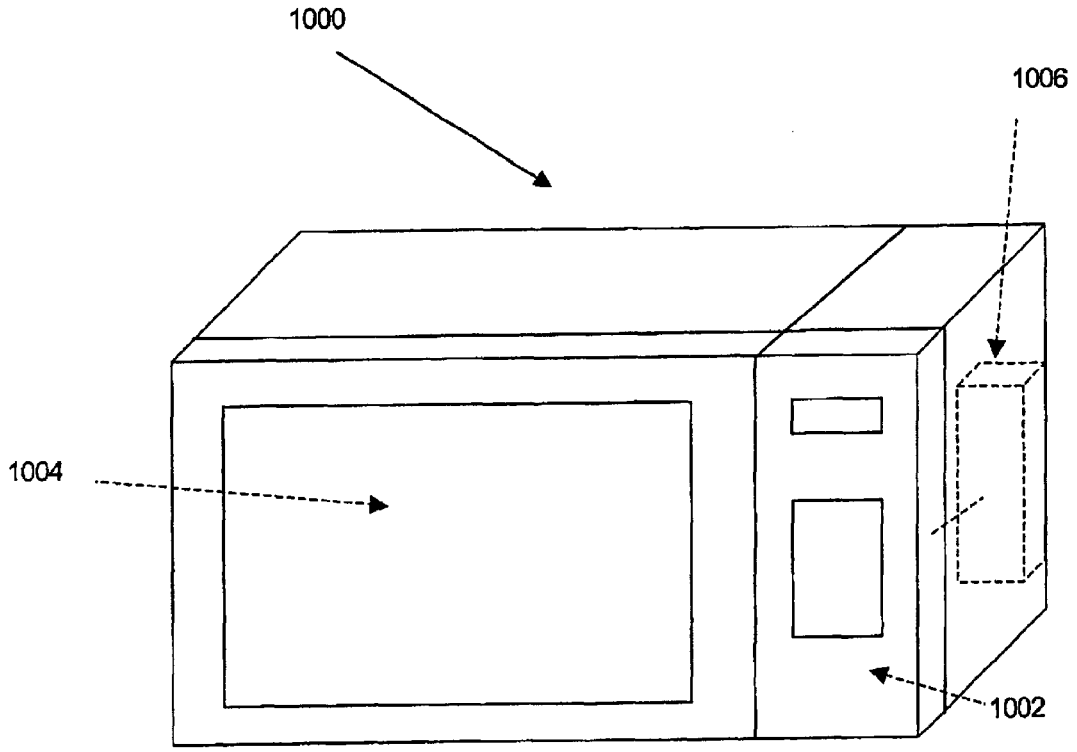
FIG. 10 is a schematic representation of a microwave that implements a magnetron in accordance with an embodiment of the present invention.

The magnetron of the present invention may be used in a microwave oven. As illustrated in FIG. 10, in such an implementation, the microwave oven 1000 typically also includes a control unit 1002, a cooking cavity 1004 and a heating unit 1006, wherein the heating unit includes the magnetron. In general, the control unit 1002 may be operated by user input, controlling the amount of heat to be delivered by the magnetron in the heating unit 1006, so that food may be cooked in the cooking cavity 1004. Since numerous control units are known in the art for use in microwave ovens, no further description of a control unit is provided.

Figure 11:
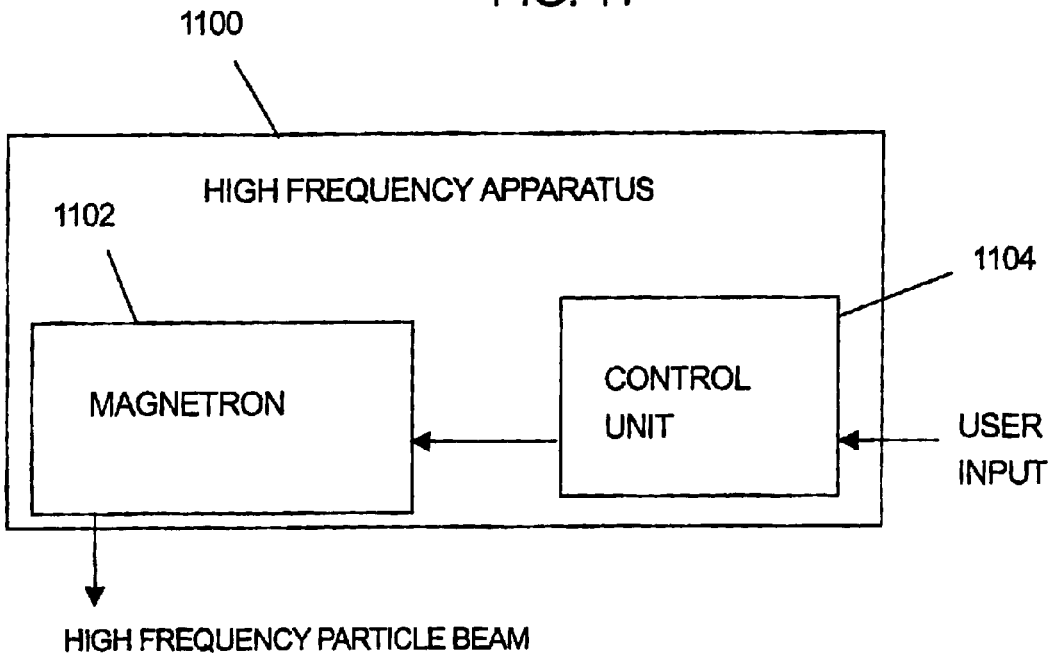
FIG. 11 is a block diagram of a high frequency apparatus having a magnetron in accordance with an embodiment of the present invention.

The magnetron of the present invention may be used in industrial applications such as, for example, high frequency heating apparatuses, particle accelerators and radar units. As shown in the block diagram of FIG. 11, a high frequency apparatus 1100 such as a high frequency heating apparatus, a particle accelerator or a radar unit in accordance with the present invention typically includes a magnetron 1102 as described herein that generates a high frequency particle beam and a control unit 1104 that controls an intensity of the high frequency particle beam. Since numerous control units are known in the art for use in high frequency apparatuses, no further description of a control unit is provided.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A magnetron, comprising:

a ring-shaped anode forming a plurality of resonance circuits;

a cathode disposed at an axial center of the anode to emit thermions, separated from the anode by a predetermined space;

a ring-shaped permanent magnet provided above the anode;

an upper pole piece having a magnetic flux dispersing structure to carry magnetic flux generated by the permanent magnet to an upper portion of the predetermined space, wherein the upper pole piece comprises:

a ring-shaped magnetic flux receiving portion disposed between the permanent magnet and the anode to receive magnetic flux generated by the permanent magnet;

a slanted portion downwardly slantingly extended from an inner edge of the ring-shaped magnetic flux receiving portion to an upper portion of the predetermined space to carry received magnetic flux to the upper portion of the predetermined space; and a magnetic flux dispersing portion upwardly slantingly extended from an upper edge of the slanted portion to disperse the carried magnetic flux;

a lower pole piece carrying the magnetic flux to a lower portion of the predetermined space; and at least one yoke magnetically connecting the permanent magnet with the lower pole piece.

2. A microwave oven, comprising:

a magnetron as set forth in claim 1.

3. A high frequency heating apparatus, comprising:

a magnetron as set forth in claim 1.

4. A magnetron, comprising:

a ring-shaped anode forming a plurality of resonance circuits;

a cathode disposed at an axial center of the anode to emit thermions, separated from the anode by a predetermined space;

a ring-shaped permanent magnet provided above the anode;

an upper pole piece having a magnetic flux dispersing structure to carry magnetic flux generated by the permanent magnet to an upper portion of the predetermined space;

a lower pole piece having a magnetic flux concentrating structure to carry the magnetic flux to a lower portion of the predetermined space, wherein the lower pole piece comprises:

a ring-shaped magnetic flux receiving portion designed to receive magnetic flux carried through the at least one yoke from the permanent magnet; and a slanted portion upwardly slantingly extended from an upper edge of the ring-shaped magnetic flux receiving portion to the lower portion of the predetermined space to carry the received magnetic flux to the lower portion of the predetermined space; and at least one yoke magnetically connecting the permanent magnet with the lower pole piece.

5. The magnetron as set forth in claim 4, wherein the upper pole piece comprises a ring-shaped magnetic flux receiving portion disposed between the permanent magnet and the anode to receive magnetic flux generated by the permanent magnet, a slanted portion downwardly slantingly extended from an upper edge of the ring-shaped magnetic flux receiving portion to an upper portion of the predetermined space to carry received magnetic flux to the upper portion of the predetermined space, and a magnetic flux dispersing portion upwardly slantingly extended from an upper edge of the slanted portion to disperse the carried magnetic flux.

6. The magnetron as set forth in claim 5, wherein an angle formed between the magnetic flux receiving portion and slanted portion of the lower pole piece is greater than an angle formed between the magnetic flux receiving portion and slanted portion of the upper pole piece.

7. A magnetron, comprising:

a ring-shaped anode forming a plurality of resonance circuits;

a cathode disposed at an axial center of the anode to emit thermions, separated from the anode by a predetermined space;

a ring-shaped permanent magnet provided above the anode;

an upper pole piece having a magnetic flux dispersing structure to carry magnetic flux generated by the permanent magnet to an upper portion of the predetermined space;

a lower pole piece having a magnetic flux concentrating structure to carry the magnetic flux to a lower portion of the predetermined space;

wherein the upper pole piece comprises:

a ring-shaped magnetic flux receiving portion disposed between the permanent magnet and the anode to receive magnetic flux generated by the permanent magnet;

a slanted portion downwardly slantingly extended from an inner edge of the ring-shaped magnetic flux receiving portion to an upper portion of the predetermined space to carry received magnetic flux to the upper portion of the predetermined space; and a magnetic flux dispersing portion upwardly slantingly extended from an inner edge of the slanted portion portion to disperse the carried magnetic flux; and at least one yoke magnetically connecting the permanent magnet with the lower pole piece.

8. The magnetron as set forth in claim 7, wherein the lower pole piece comprises a ring-shaped magnetic flux receiving portion designed to receive magnetic flux carried through the at least one yoke from the permanent magnet, and a slanted portion upwardly slantingly extended from an inner edge of the ring-shaped magnetic flux receiving portion to the lower portion of the predetermined space to carry the received magnetic flux to the lower portion of the predetermined space.

9. The magnetron as set forth in claim 8, wherein an angle formed between the magnetic flux receiving portion and slanted portion of the lower pole piece is greater than an angle formed between the magnetic flux receiving portion and slanted portion of the upper pole piece.

10. A microwave oven, comprising:

a cooking cavity in which food is placed to be cooked;

a heating unit to heat the food, the heating unit comprising:

a magnetron, comprising:

a ring-shaped anode forming a plurality of resonance circuits;

a cathode disposed at an axial center of the anode to emit thermions, separated from the anode by a predetermined space;

a ring-shaped permanent magnet provided above the anode;

an upper pole piece having a magnetic flux dispersing structure to carry magnetic flux generated by the permanent magnet to an upper portion of the predetermined space;

a lower pole piece having a magnetic flux concentrating structure to carry the magnetic flux to a lower portion of the predetermined space, wherein the lower pole piece comprises:

a ring-shaped magnetic flux receiving portion designed to receive magnetic flux carried through the at least one yoke from the permanent magnet; and a slanted portion upwardly slantingly extended from an inner edge of the ring-shaped magnetic flux receiving portion to the lower portion of the predetermined space to carry the received magnetic flux to the lower portion of the predetermined space; and at least one yoke magnetically connecting the permanent magnet with the lower pole piece.

11. A microwave oven, comprising:

a cooking cavity in which food is placed to be cooked;

a heating unit to heat the food, the heating unit comprising:

a magnetron, comprising:

a ring-shaped anode forming a plurality of resonance circuits;

a cathode disposed at an axial center of the anode to emit thermions, separated from the anode by a predetermined space;

a ring-shaped permanent magnet provided above the anode;

an upper pole piece having a magnetic flux dispersing structure to carry magnetic flux generated by the permanent magnet to an upper portion of the predetermined space;

a lower pole piece having a magnetic flux concentrating structure to carry the magnetic flux to a lower portion of the predetermined space, wherein the upper pole piece comprises:

a ring-shaped magnetic flux receiving portion disposed between the permanent magnet and the anode to receive magnetic flux generated by the permanent magnet;

a slanted portion downwardly slantingly extended from an inner edge of the ring-shaped magnetic flux receiving portion to an upper portion of the predetermined space to carry received magnetic flux to the upper portion of the predetermined space; and a magnetic flux dispersing portion upwardly slantingly extended from an inner edge of the slanted portion to disperse the carried magnetic flux; and at least one yoke magnetically connecting the permanent magnet with the lower pole piece.

12. A microwave oven, comprising:

a cooking cavity in which food is placed to be cooked;

a heating unit to heat the food, the heating unit comprising:

a magnetron, comprising:

a ring-shaped anode forming a plurality of resonance circuits;

a cathode disposed at an axial center of the anode to emit thermions, separated from the anode by a predetermined space;

a ring-shaped permanent magnet provided above the anode;

at least one yoke;

a lower pole piece carrying magnetic flux generated by the permanent magnet to an upper portion of the predetermined space;

an upper pole piece comprising a ring-shaped magnetic flux receiving portion designed to receive magnetic flux carried through the at least one yoke from the permanent magnet, and a slanted portion upwardly slantingly extended from an inner edge of the ring-shaped magnetic flux receiving portion to a lower portion of the predetermined space to carry received magnetic flux to the lower portion of the predetermined space; and the at least one yoke magnetically connecting the permanent magnet with the lower pole piece; and a control unit to control an amount of heat produced by the heating unit.

13. A magnetron, comprising:

a concentric cathode-anode pair, the anode being a ring-shaped anode forming a plurality of resonance circuits and the cathode separated form the anode by a space;

a ring-shaped permanent magnet provided above the anode;

an upper pole piece having a magnetic flux dispersing structure to carry magnetic flux generated by the permanent magnet to an upper portion of the predetermined space;

a lower pole piece having a magnetic flux concentrating structure to carry the magnetic flux to a lower portion of the predetermined space, wherein the lower pole piece comprises:

a ring-shaped magnetic flux receiving portion designed to receive magnetic flux carried through the at least one yoke from the permanent magnet; and a slanted portion upwardly slantingly extended from an inner edge of the ring-shaped magnetic flux receiving portion to the lower portion of the predetermined space to carry the received magnetic flux to the lower portion of the predetermined space; and at least one yoke magnetically connecting the permanent magnet with the lower pole piece.

14. The magnetron as set forth in claim 13, wherein the upper pole piece comprises a ring-shaped magnetic flux receiving portion disposed between the permanent magnet and the anode to receive magnetic flux generated by the permanent magnet, a slanted portion downwardly slantingly extended from an inner edge of the ring-shaped magnetic flux receiving portion to an upper portion of the predetermined space to carry received magnetic flux to the upper portion of the predetermined space, and a magnetic flux dispersing portion upwardly slantingly extended from an inner edge of the slanted portion to disperse the carried magnetic flux.

15. A high frequency apparatus, comprising:

a high frequency particle accelerating unit comprising:

a magnetron, comprising:

a ring-shaped anode forming a plurality of resonance circuits;

a cathode disposed at an axial center of the anode to emit thermions, separated from the anode by a predetermined space;

a ring-shaped permanent magnet provided above the anode;

an upper pole piece carrying magnetic flux generated by the permanent magnet to an upper portion of the predetermined space;

at least one yoke; and a lower pole piece comprising a ring-shaped magnetic flux receiving portion designed to receive magnetic flux carried through the at least one yoke from the permanent magnet, and a slanted portion upwardly slantingly extended from an inner edge of the ring-shaped magnetic flux receiving portion to a lower portion of the predetermined space to carry received magnetic flux to the lower portion of the predetermined space, wherein the at least one yoke magnetically connects the permanent magnet to the lower pole piece, the magnetron generating a high frequency particle beam; and a control unit to control an intensity of the high frequency particle beam.

16. The high frequency apparatus of claim 15, wherein the apparatus is one of: a high frequency heating apparatus, a particle accelerator and a radar unit.

17. A high frequency apparatus, comprising:

a high frequency particle accelerating unit comprising:

a magnetron, comprising:

a ring-shaped anode forming a plurality of resonance circuits;

a cathode disposed at an axial center of the anode to emit thermions, separated from the anode by a predetermined space;

a ring-shaped permanent magnet provided above the anode;

an upper pole piece having a magnetic flux dispersing structure to carry magnetic flux generated by the permanent magnet to an upper portion of the predetermined space;

a lower pole piece having a magnetic flux concentrating structure to carry the magnetic flux to a lower portion of the predetermined space, wherein the upper pole piece comprises:

a ring-shaped magnetic flux receiving portion disposed between the permanent magnet and the anode to receive magnetic flux generated by the permanent magnet;

a slanted portion downwardly slantingly extended from an inner edge of the ring-shaped magnetic flux receiving portion to an upper portion of the predetermined space to carry received magnetic flux to the upper portion of the predetermined space; and a magnetic flux dispersing portion upwardly slantingly extended from an inner edge of the slanted portion to disperse the carried magnetic flux; and at least one yoke magnetically connecting the permanent magnet with the lower pole piece.

18. The high frequency apparatus of claim 17, wherein the apparatus is one of: a high frequency heating apparatus, a particle accelerator and a radar unit.

19. A high frequency heating apparatus, comprising:

a high frequency particle accelerating unit comprising:

a magnetron, comprising:

a ring-shaped anode forming a plurality of resonance circuits;

a cathode disposed at an axial center of the anode to emit thermions, separated from the anode by a predetermined space;

a ring-shaped permanent magnet provided above the anode;

at least one yoke;

a lower pole piece carrying magnetic flux generated by the permanent magnet to an upper portion of the predetermined space;

an upper pole piece comprising a ring-shaped magnetic flux receiving portion designed to receive magnetic flux carried through the at least one yoke from the permanent magnet, and a slanted portion upwardly slantingly extended from an inner edge of the ring-shaped magnetic flux receiving portion to a lower portion of the predetermined space to carry received magnetic flux to the lower portion of the activating space; and the at least one yoke magnetically connecting the permanent magnet with the lower pole piece, the magnetron generating a high frequency particle beam; and a control unit to control an intensity of the high frequency particle beam.

20. The high frequency apparatus of claim 19, wherein the apparatus is one of: a high frequency heating apparatus, a particle accelerator and a radar unit.

* * * * *

UNITED STATES PATENT AND TRADEMARK OFFICE

CERTIFICATE OF CORRECTION

PATENT NO. : 6,921,889 B2
DATED : July 26, 2005
INVENTOR(S) : Jong-Chull Shon et al.

It is certified that error appears in the above-identified patent and that said Letters Patent is hereby corrected as shown below:

Column 9,
Lines 33 and 65, change “upper” to -- inner --.

Column 10,
Lines 11 and 16, change “upper” to -- inner --.
Line 51, change “slanted portion portion” to -- slanted portion --.

Signed and Sealed this

Twenty-eighth Day of March, 2006

JON W. DUDAS
*Director of the United States Patent and Trademark Office*